US005394726A

United States Patent [19]

Bogart et al.

[11] Patent Number: 5,394,726

[45] Date of Patent: Mar. 7, 1995

[54] APPARATUS AND METHOD FOR POSITIONING AND PRESSING CURVED SURGICAL NEEDLES

[75] Inventors: Michael W. Bogart, Milford; Richard J. Smith, Stamford, both of Conn.

[73] Assignee: United States Surgical Corporation, Norwalk, Conn.

[21] Appl. No.: 134,140

[22] Filed: Oct. 8, 1993

Related U.S. Application Data

[63] Continuation-in-part of Ser. No. 959,050, Oct. 9, 1992, Pat. No. 5,323,633.

[51] Int. Cl.[6] ..... B21D 43/10; B21G 3/28

[52] U.S. Cl. ..... 72/311; 72/407; 72/422; 163/1; 163/5

[58] Field of Search ..... 72/422, 407, 416, 311, 72/293; 163/1, 5

[56] References Cited

U.S. PATENT DOCUMENTS

| | | | |
|---|---|---|---|
| 512,912 | 1/1894 | Smith | 163/1 |
| 2,055,198 | 9/1936 | Hofmann | 163/1 |
| 3,890,975 | 6/1975 | McGregor | 163/1 |
| 4,306,443 | 12/1981 | Matsutani | 72/416 |
| 4,922,904 | 5/1990 | Uetake | 163/1 |
| 5,099,676 | 3/1992 | Proto | 72/416 |

FOREIGN PATENT DOCUMENTS

| | | | |
|---|---|---|---|
| 63-73989 | 4/1988 | Japan . | |
| 299834 | 12/1988 | Japan | 163/1 |
| 63-309338 | 12/1988 | Japan . | |

*Primary Examiner*—Daniel C. Crane

[57] ABSTRACT

The present invention relates to an apparatus and method for positioning and pressing surgical needle blanks. The apparatus includes a needle blank transferring system which transfers needle blanks between a gripping position and a pressing position. A side press system presses a portion of the needle blank when the blank is in the pressing position, and a gripping member is provided to hold the needle blank at least during the transfer and press operations of the apparatus. The method according to the present invention includes inserting a needle blank into a needle blank gripping member at a gripping position, transferring the needle blank between the gripping position and a pressing position, and pressing a side portion of a body portion of the needle blank with pressing dies.

20 Claims, 7 Drawing Sheets

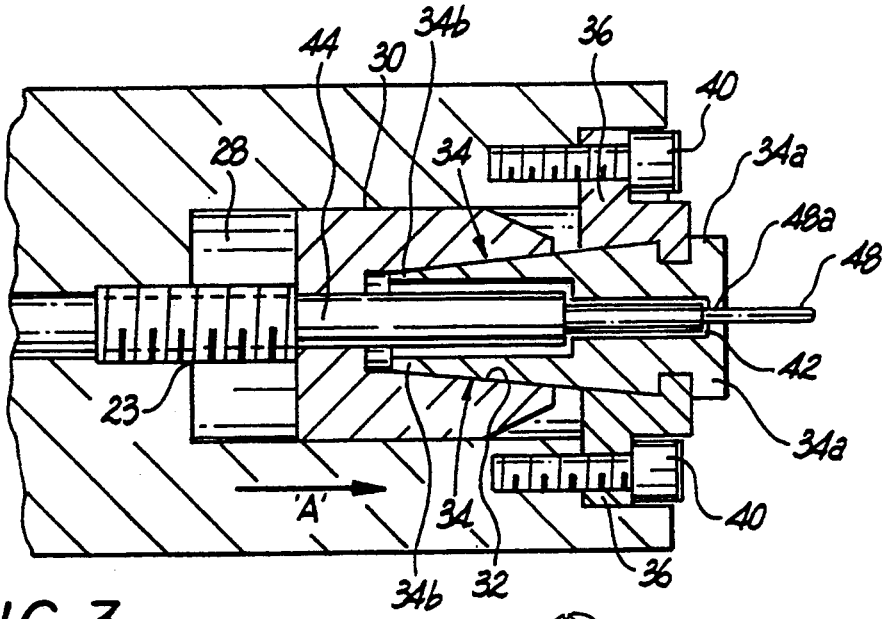
FIG. 3
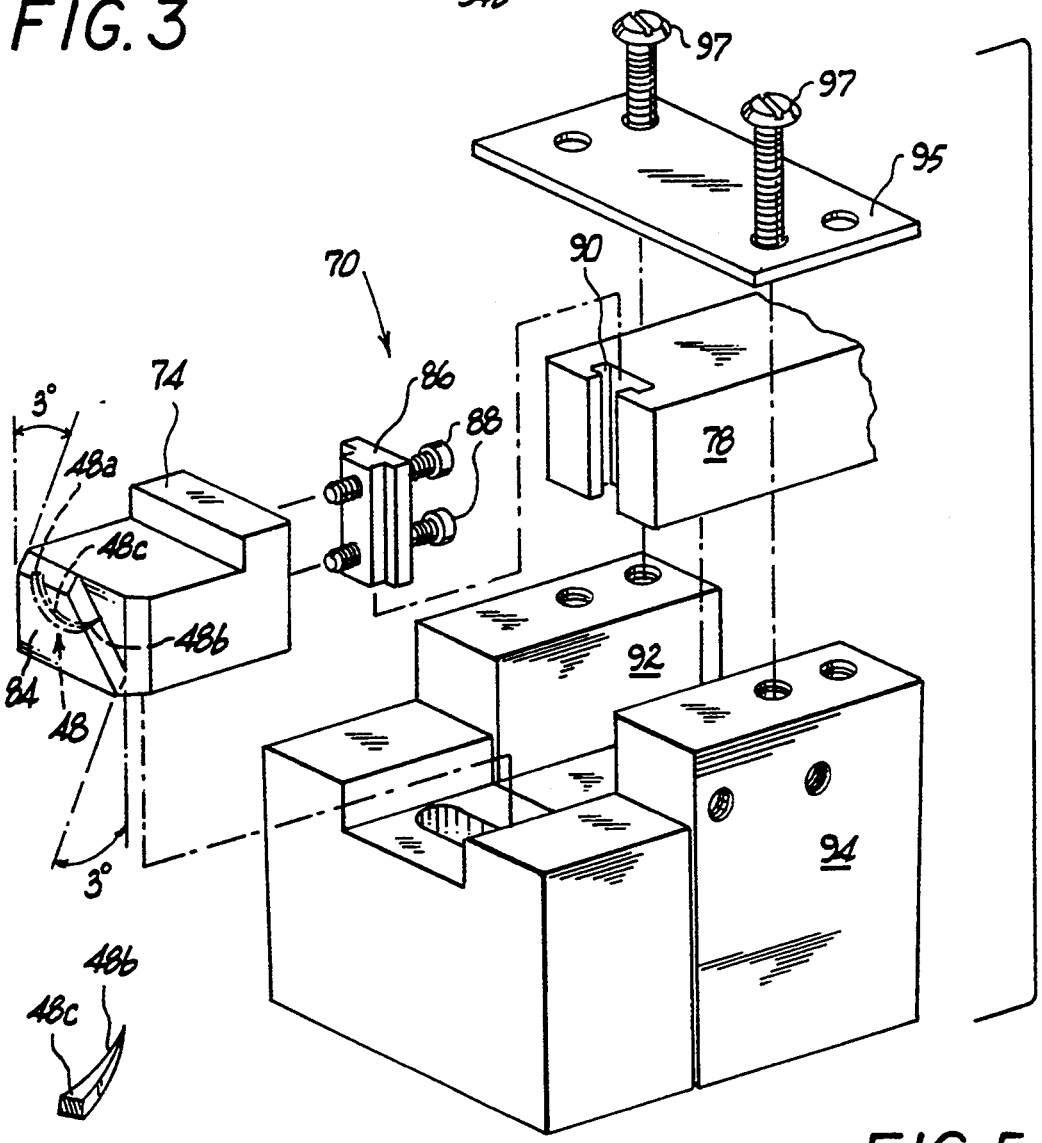
FIG. 5A
FIG. 5

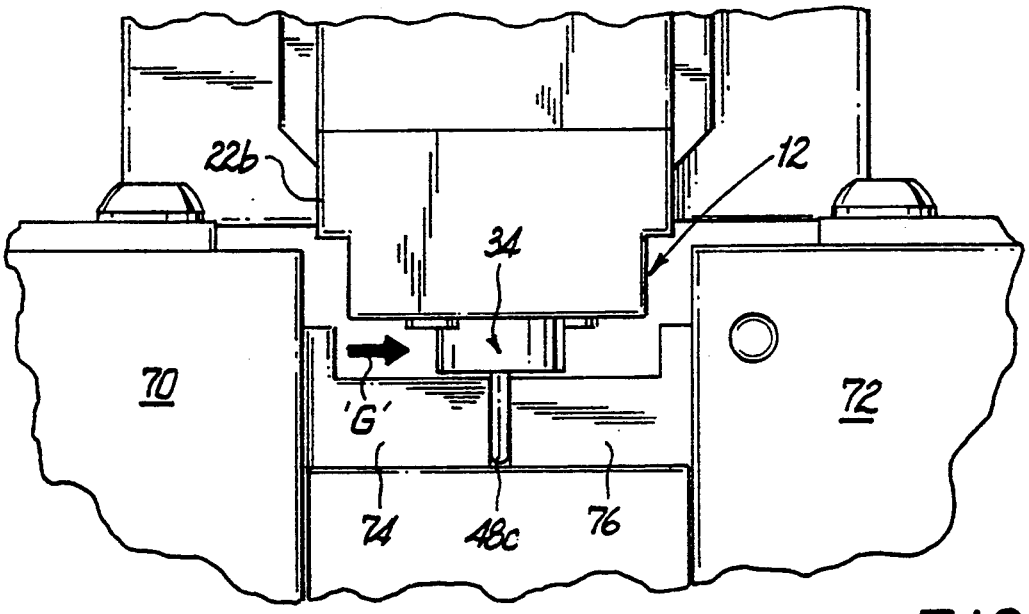
FIG. 9
FIG. 10
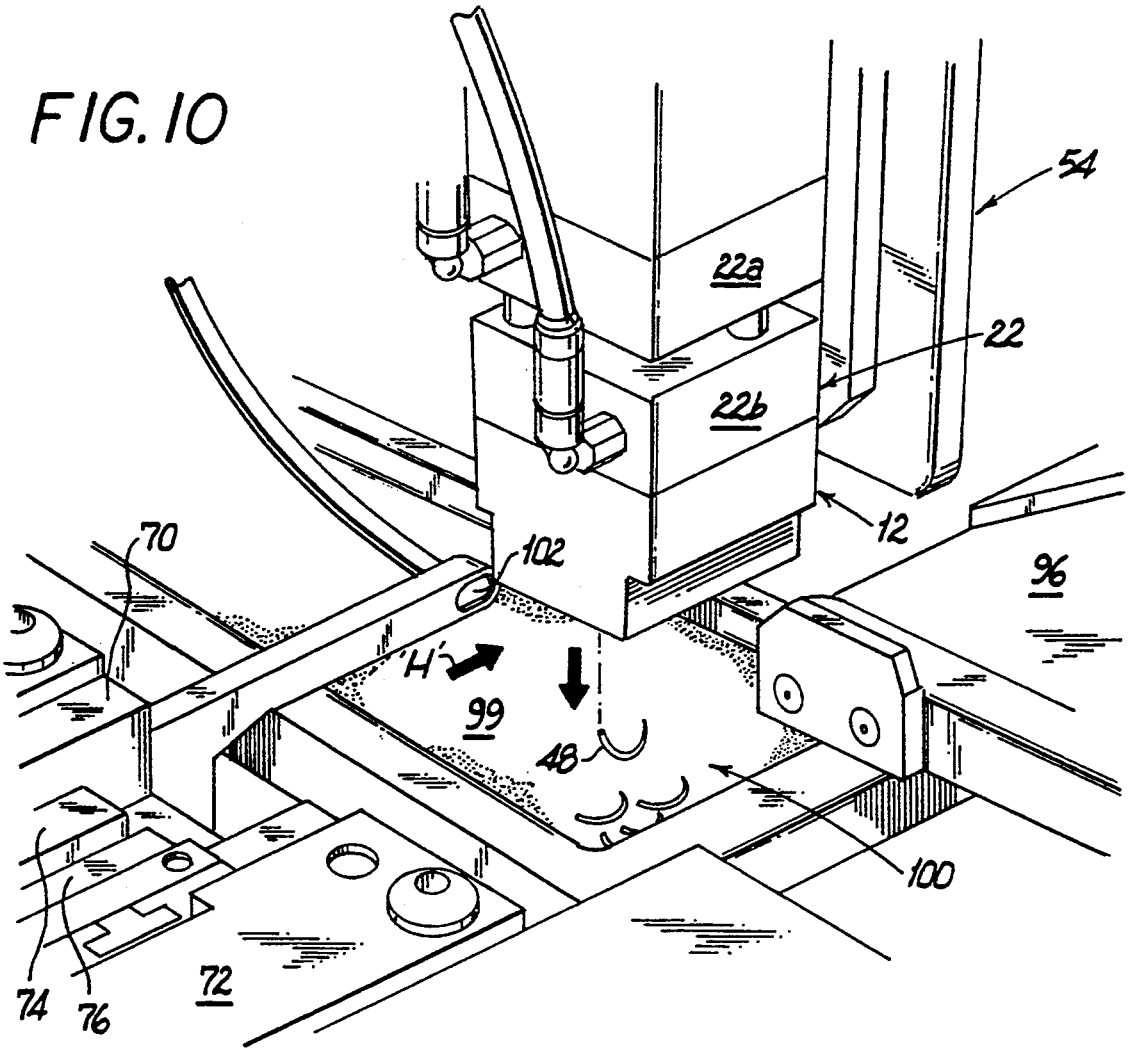

APPARATUS AND METHOD FOR POSITIONING AND PRESSING CURVED SURGICAL NEEDLES

CROSS REFERENCE TO RELATED APPLICATION

This application is a continuation-in-part of application Ser. No. 07/959,050, filed Oct. 9, 1992, now U.S. Pat. No. 5,323,633, issued Jun. 28, 1994.

BACKGROUND OF THE INVENTION

1. Field of the Invention

The present invention relates to an apparatus for side pressing surgical needles. More particularly, the present invention relates to an apparatus for sequentially positioning and side pressing curved surgical needles.

2. Description of the Related Art

The production of needles involves many processes and different types of machinery in order to prepare quality needles from raw stock. These varying processes and machinery become more critical in the preparation of surgical needles where the environment of intended use is in humans or animals. Some of the processes involved in the production of surgical grade needles include, inter alia: straightening spooled wire stock; cutting needle blanks from the wire stock; providing a bore for receiving suture thread at the other end of the blank; tapering or grinding points on one end of the blank; flat pressing a portion of the needle blank to facilitate easier grasping by surgical instrumentation; and curving the blanks where curved surgical needles are desired. To further facilitate grasping of the needle blank by surgical instrumentation and to facilitate insertion into humans or animals, a body portion of the curved needle blank may be side pressed.

Conventional needle blank processing is, in large part, a labor intensive operation requiring highly skilled labor. Generally, extreme care must be taken to ensure that only the intended working of the needle blank is performed and the other parts of the needle blank remain undisturbed. For example, conventional flat pressing techniques create the flat edges on the body portion of the needle blank by pressing the needle blank between a pair of opposing needle dies having the desired length and width characteristics. Typically, the needle blanks are manually placed on a lower die and compressed between the dies to impart the flat surfaces. The flat pressed blanks are then manually removed from the dies and deposited into a storage receptacle for distribution to another production machine.

As noted above, to facilitate grasping of the needle and insertion into body tissue, after flat pressing and curving, the needle blank is then side pressed to obtain a substantially rectangular cross-section in the needle body. As with the above flat press process, conventional side pressing techniques require manual insertion of the blank between a pair of dies which are caused to impact and compress the sides of a body portion of the needle blank opposite to those surfaces which were flat pressed to form the substantial rectangular cross-section in the needle body.

One disadvantage of conventional needle forming techniques is that curved needles are manually positioned between pressing dies for side pressing a portion of the needle body. For example, should any needles be improperly positioned within the dies they will become deformed rendering the needles unsuitable for their intended use. In such instances the deformed needles are discarded or reprocessed. The incidence of needle damage during the forming process has been relatively high due to the manual placement of the needles within the various machinery resulting in a relatively high percentage of deformed and rejected needles.

One type of apparatus utilized to present curved needles for side pressing is described in commonly assigned U.S. patent application Ser. No. 07/959,050 to Michael W. Bogart and Richard J. Smith, filed Oct. 9, 1992. In this application, curved needle blanks are vertically and horizontally orientated between a pair of dies which are activated to advance relative to each other to strike the blank. Vertical and horizontal pusher members are used to transport and orientate the needle blanks between the dies.

The present invention relates to a new and inventive apparatus for precisely positioning curved needles for side pressing and for subsequent deposit into a storage receptacle. The needle positioning and pressing apparatus of the present invention automatically transports curved surgical needle blanks between a grasping position and a pressing position, side presses a portion of the curved needle and subsequently deposits the side pressed needle blank into a storage receptacle for distribution to other needle blank manufacturing machinery.

SUMMARY OF THE INVENTION

The present invention relates to an apparatus and method for positioning and side pressing surgical needle blanks. Generally, the apparatus includes means for transferring the at least one needle blank between a gripping position, a pressing position and a needle blank release position, a gripping assembly attached to the needle blank transferring means, and means for side pressing at least a portion of the needle blank when the needle blank is in the pressing position.

The needle blank transferring means of the invention preferably includes, means for moving the needle blank in a first level between the gripping position and an intermediate position, means for moving the needle blank between the first level and a second level, and means for moving the needle blank in the second level from the intermediate portion to the pressing position. In the preferred embodiment, the means for moving the needle blank between the first level and the second level is a rotatable arm having the needle gripping assembly attached thereto at a radial distance from an axis of rotation of the arm.

The gripping assembly of the present invention includes a housing and at least two gripping fingers partially positioned within the housing. Preferably, each gripping finger has a biasing end portion and a gripping end portion which is movable between open and closed positions. The gripping assembly also includes means for engaging the biasing end portion of the gripping fingers to move the gripping end portion between the open and closed positions. A needle stop member may also be provided to limit the depth of insertion of the needle blank between the fingers.

The present invention also relates to a method for pressing surgical needle blanks, which comprises inserting a needle blank into a needle blank gripping member at a gripping position, transferring the needle blank between the gripping position and a pressing position, and hydraulically pressing a side portion of the body portion of the needle blank with hydraulic pressing dies. Once the needle blank is side pressed, the blank is transferred to a release position and released from the needle blank gripping member into a storage receptacle.

BRIEF DESCRIPTION OF THE DRAWINGS

Preferred embodiments of the invention are described hereinbelow with reference to the drawings wherein:

FIG. 3 is a partial cross-sectional view of the needle gripping member of FIG. 2, illustrating a needle blank secured between gripping members;

FIG. 5 is a perspective view of an exemplary pressing die assembly which forms part of the present invention;

FIG. 5A is a perspective view of a portion of an exemplary needle blank after being pressed by the die assembly of FIG. 5, the needle blank having a substantially rectangular cross-section; and FIGS. 6–10 illustrate the needle gripping member and the various motions traveled thereby to transfer needles between a gripping position, a pressing position and a release position.

DETAILED DESCRIPTION OF THE PREFERRED EMBODIMENTS

Figure 1:
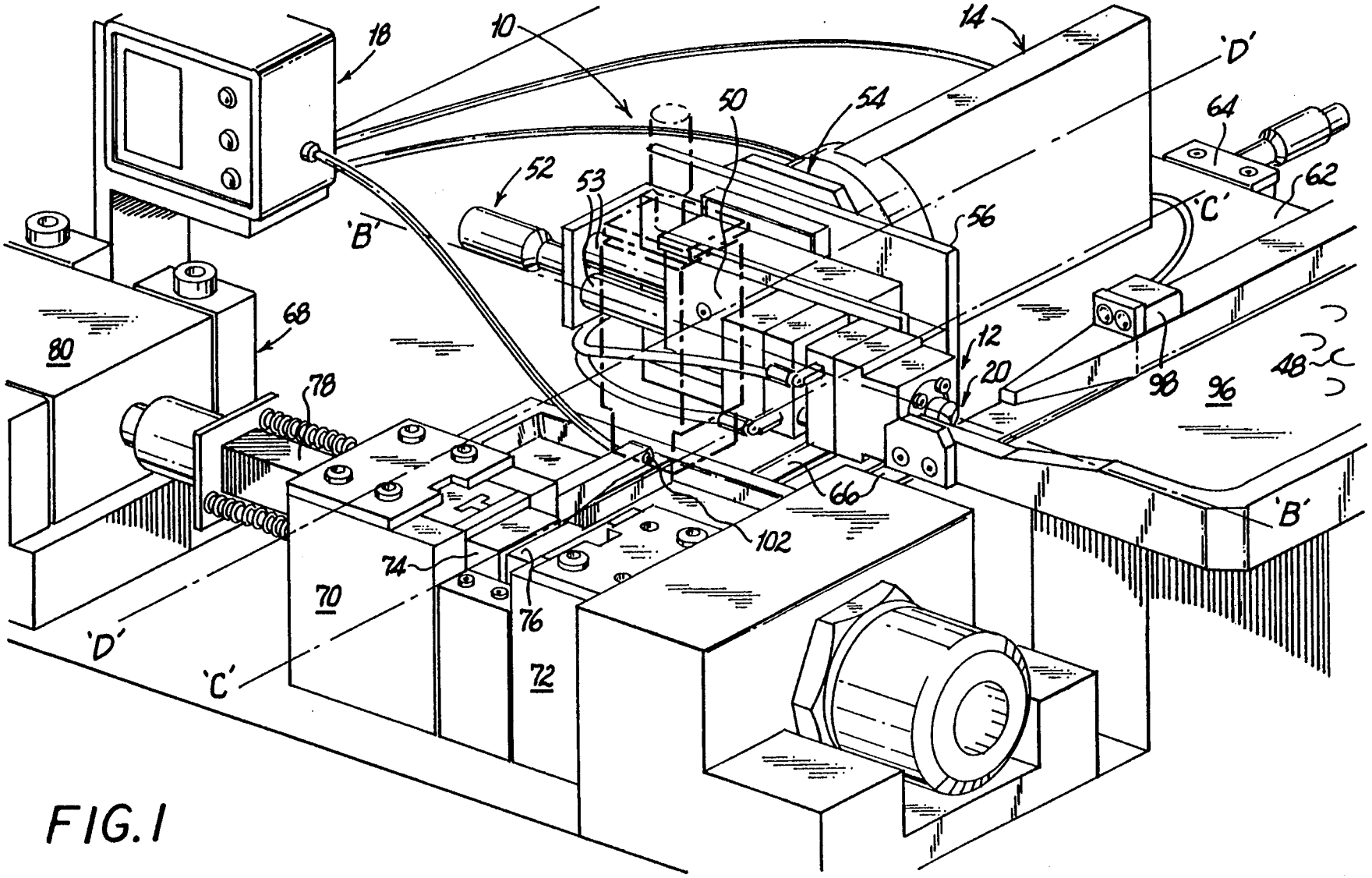
FIG. 1 is a perspective view of the needle blank positioning and pressing apparatus of the present invention illustrating the rotational movement of the needle blank gripping assembly.

Referring to the drawings and in particular to FIG. 1, the needle blank positioning and pressing apparatus 10 of the present invention generally includes needle blank gripping assembly 12, needle blank transferring assembly 14, side pressing assembly 16 and control unit 18. Control unit 18 is provided to control the operation of the gripping assembly 12, the transferring assembly 14 and the side pressing assembly 16 so as to coordinate the actuation of each assembly. Control units for the apparatus of the present invention are known in the art. One such example is the PLC, manufactured by Allen-Bradley, Milwaukee, Wis.

Figure 2:
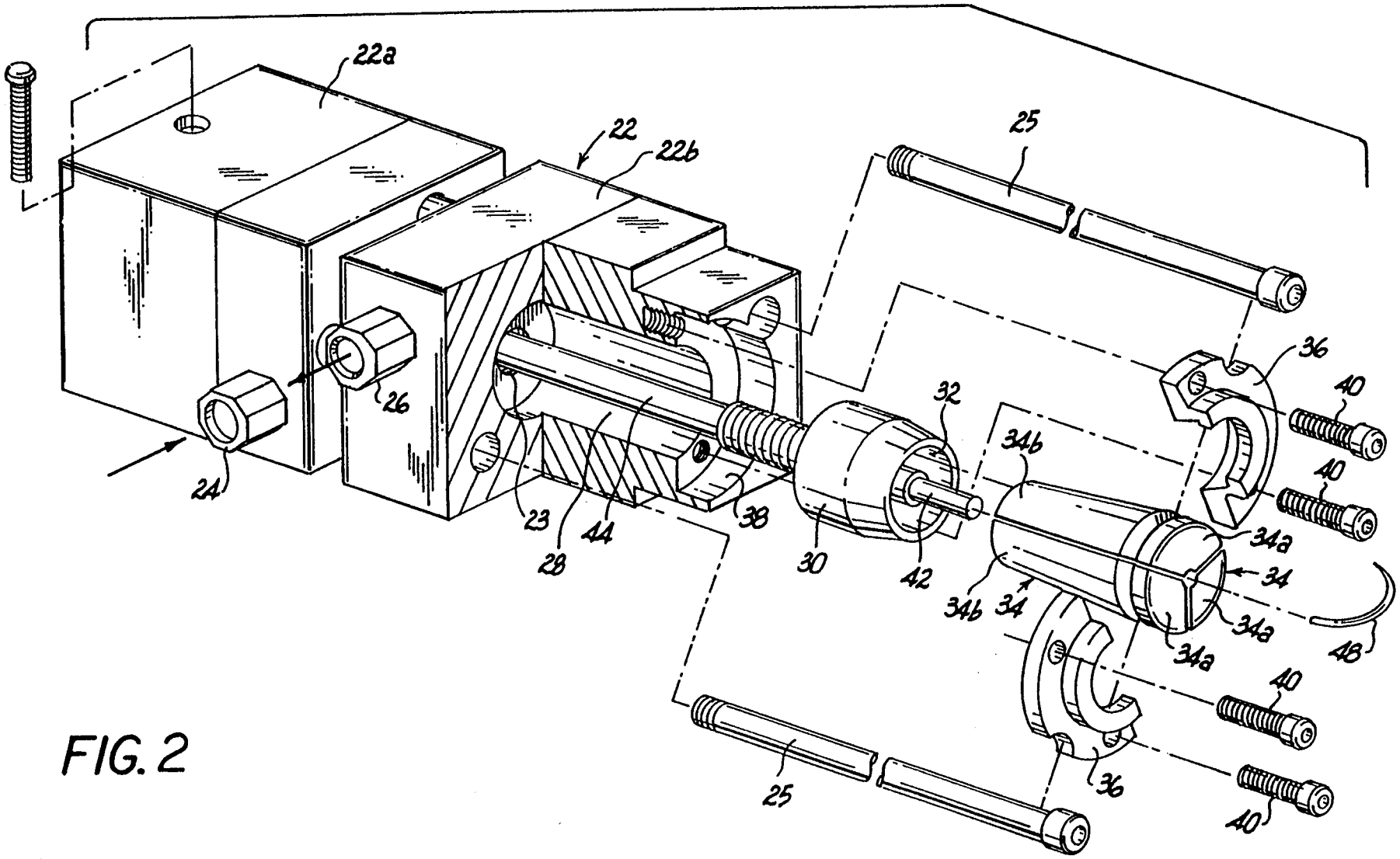
FIG. 2 is a perspective view with parts separated of the needle gripping member of the present invention.

Referring to FIG. 1, in conjunction with FIGS. 2 and 3 the needle blank gripping assembly 12 of the present invention is provided to receive the barrel end portion of a curved needle blank at a gripping position 20 and to maintain the blank in a fixed relationship thereto while the blank is transferred from the gripping position to a pressing position. Gripping assembly 12 also maintains the needle blank during the side press cycle and when the blank is transferred to a release position for depositing into a storage receptacle. As shown in FIGS. 2 and 3, gripping assembly 12 includes two part housing 22. The first portion **22*a* of housing 22 has an air inlet port 24 which permits the introduction of air from a suitable source (not shown) into channel 28 via passageway 23 to close needle gripping fingers 34 about the needle blank 48. The second portion 22*b* of housing 22 has an exhaust port 26 which permits the release of air pressure from channel 28 to open gripping fingers 34 and release the needle blank 48. The housing portions 22*a* and 22*b* are secured together by set screws 25. Referring to FIG. 2, collar 30 is positioned within channel 28 of second housing portion 22*b*. Air pressure is directed to inlet port 24 and from exhaust port 26 in an appropriately cycled fashion to cause collar 30 to move longitudinally within channel 28 in response to such varying air pressure. For example, the air pressure to inlet port 24 may be selected to cause collar 30 to move toward gripping fingers 34 and the air pressure may be reduced to cause collar 30 to be withdrawn into channel 28 away from fingers 34. Collar 30 is configured and dimensioned to maintain an air tight seal between the outer wall of collar 30 and the inner wall of channel 28. To further maintain the air tight seal, an o-ring (not shown) may be positioned on collar 30, or silicone grease may be applied to the inner wall of channel 28 or the outer wall of collar 30. Other seal maintaining members or substances are also contemplated. Preferably, collar 30 includes a tapered hollowed forward portion 32 which is configured to receive the gripping fingers 34 while engaging the outer surfaces of these gripping fingers. As shown in FIG. 3, gripping fingers 34 are tapered so that the needle gripping end 34*a* of each finger 34 has a larger radius of curvature than the base portion 34*b* of finger 34. In this configuration, collar 30 slides along base portion 34*b* of gripping fingers 34 to cause the gripping end 34*a* of each gripping finger 34 to converge toward the barrel end portion 48*a* of a curved needle blank 48 inserted therebetween so as to grip the needle blank and maintain it in the position shown in FIG. 3**.

Referring again to FIGS. 2 and 3, needle gripping fingers 34 are secured partially within channel 28 of housing 22 by retaining plates 36 which are secured within channel 38 of second housing portion **22*b* by set screws 40. Needle stop 42 is connected to rod 44 which extends between the housing portions 22*a* and 22*b*. As shown in FIG. 3, needle stop 42 and a portion of rod 44 are positioned between gripping fingers 34 and are provided to limit the depth of insertion of the barrel end portion 48*a* of the needle blank 48. In addition, rod 44 imposes an outwardly directed radial force on the base portion 34*b* of fingers 34, so that when collar 30 retracts within channel 28 the gripping end 34*a* of fingers 34 open. Thus, when collar 30 moves reciprocally within channel 28, as may be directed by the air pressure selected by the operator, gripping fingers 34 thereby close when collar 30 slides in direction "A", identified in FIG. 3, and opens when collar 30 retracts into channel 28. Gripping fingers 34** may be fabricated from an elastomeric material, or a metal or alloy having a protective coating, such as polyurethane, so as to prevent marring of the needle blank.

Figure 4:
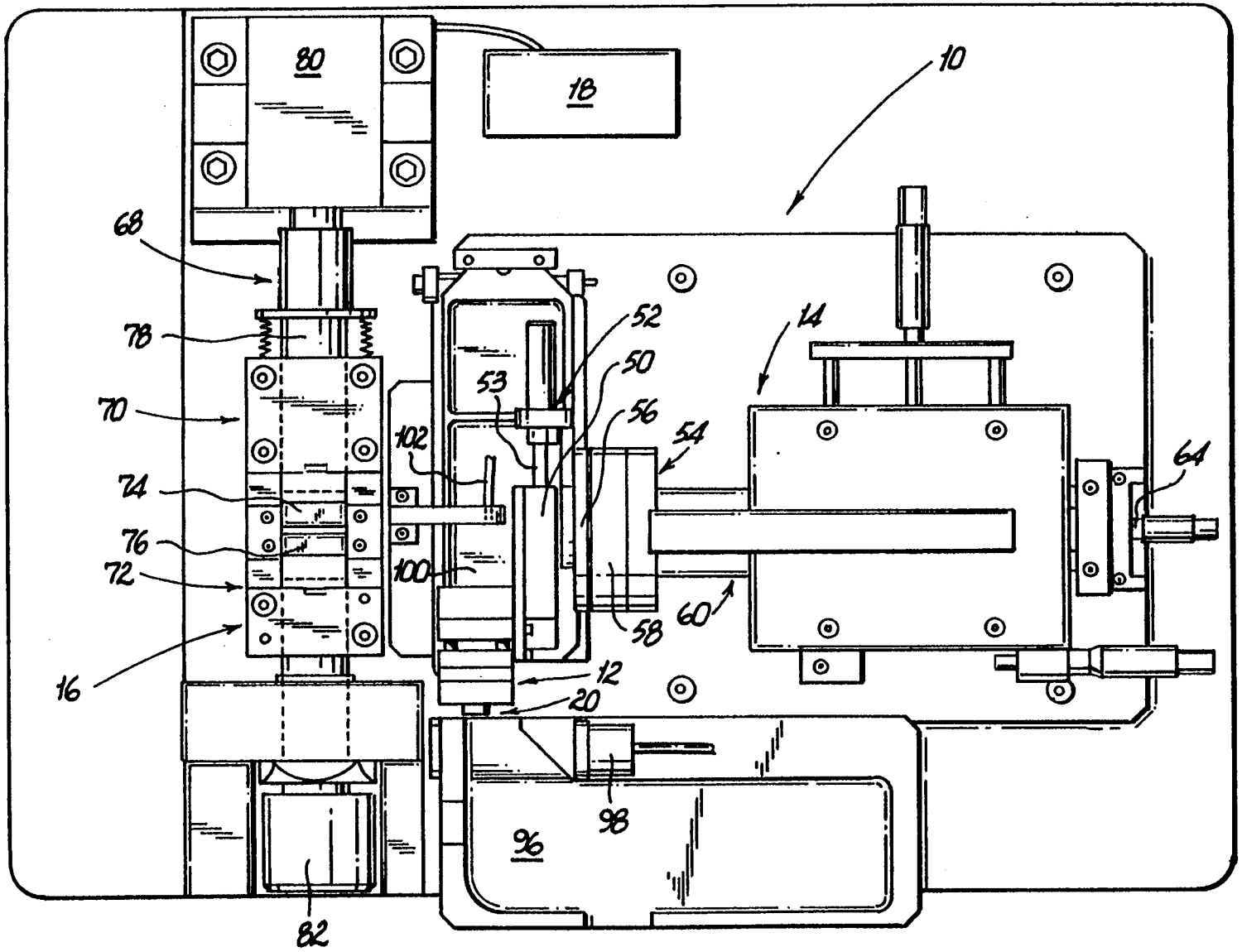
FIG. 4 is a top plan view of the apparatus of FIG. 1 as viewed from the right side of FIG. 1.

Referring to FIGS. 1 and 4, the needle blank transferring assembly 14 of the present invention includes slide track 50 and first drive member 52 which facilitate horizontal movement of the needle blank at a first level identified by axis "B—B" in FIG. 1, to and from an intermediate position and the gripping position 20 via guide rails 53. The intermediate position defines an area where needle blank gripping assembly is retracted away from gripping position 20 so that when the gripping assembly 12 is rotated, as described hereinbelow, the needle blank will be aligned for positioning between the dies 74 and 76 of side pressing assembly 16. Drive member 52 is operatively connected to control unit 18 and is responsive to actuation signals generated thereby so that the control unit can coordinate the horizontal movement of gripping assembly 12 after a needle blank has been secured between gripping fingers 34, as described hereinabove. Drive member 52 is a pneumatic piston of a type which is known in the art. However, other suitable types of drive members may be utilized.

Continuing to refer to FIGS. 1 and 4, rotating arm assembly 54 is connected to drive member 52 and is provided to facilitate movement of the needle blank between the first level at the three o'clock position, and a second level, identified by axis "C—C", at the six o'clock position, as viewed in FIG. 1. For illustrative purposes needle gripping assembly 12, shown in FIG. 1, is oriented toward the 3 O'clock position and solid lines are toward the 6 O'clock position shown in phantom lines. To accomplish the movement between levels, rotating arm assembly 54 rotates about axis "D—D", shown in FIG. 1, so that the needle blank moves between the first level and the second level after having moved to the intermediate position. Preferably, rotating arm assembly 54 includes rotating arm 56 and rotational drive member 58 which are responsive to actuation signals from control unit 18 so that the needle blank gripping assembly 12 is rotated clockwise in the intermediate position, thus moving the needle blank 48 between the first level and the second level and aligned for positioning between the dies of side pressing assembly 16.

Movement of needle blank 48 in the second level is accomplished by securing first drive member 52 and rotating arm assembly 54 to drive housing 62 of second drive member 60. Drive housing 62 is connected to drive arm 64, and guide rails 66 of second drive member 60 extend through drive housing 62 and permit housing 62 to slide therealong in response to movement of drive arm 64. Second drive member 60 moves needle blank 48 between the intermediate position and the pressing position. The pressing position is the position of needle blank 48 when it is positioned between the pressing dies and will be described in more detail below.

Referring to FIGS. 1 and 4 in conjunction with FIG. 5, the side pressing assembly 16 of the present invention includes press drive assembly 68 and pressing die assemblies 70 and 72. Each die assembly has dies 74 and 76 which can be moved toward each other to impact the needle blank 48. Preferably, pressing die assembly 70 is connected to press drive assembly 68 so that die 74 is moved toward and away from die 76, which is fixed within die assembly 72. Press drive assembly 68 includes drive piston 78 having one end connected to pressing die 74 and the other end connected to piston drive member 80. Preferably, press drive assembly 68 is connected to control unit 18 so that actuation of drive assembly 68 corresponds with positioning of the needle blank in the pressing position. In this configuration, pressing die 74 is moved toward fixed or stationary die 76 to impact needle blank 48. As noted hereinabove, side pressing of the needle blank typically occurs after the blank has been flat pressed and curved. As a result, when the dies 74 and 76 impact the needle blank, the resulting configuration of the body portion of the needle blank is a substantially rectangular cross-section, as shown in FIG. 5A.

The position of fixed die 76 of die assembly 72 with respect to needle blank 48 and pressing die assembly 70 may be adjusted by rotating knob 82 to provide sufficient force for the impact of pressing die 74. Thus, the force required to impact the needle blank and provide the substantial rectangular cross-section for the body portion of the needle blank may be varied depending on the size of the needle blank and the desired cross-section.

Referring to FIG. 5, an exemplary embodiment for the pressing die assemblies 70 and 72 is shown. Although FIG. 5 illustrates only pressing die assembly 70 in detail, it should be noted that pressing die assembly 72 is substantially the same as pressing die assembly 70 so that the following description applies to both die assemblies. As shown, pressing die assembly 70 includes die 74 which is configured to impact the body portion **48*c* of needle blank 48, shown in phantom. Preferably, the impacting surface 84 of die 74 includes marginal portions which are tapered approximately three degrees away from the surface 84 and at predefined positions, as shown in FIG. 5, so that the barrel end portion 48*a* and the pointed end portion 48*b* of needle blank 48 are not affected by the impact of the dies, i.e., the body portion 48*c* of the needle blank is impacted. Tongue 86 is secured to die 74 with set screws 88 and the combination is secured to drive piston 78 of press drive assembly 68 by inserting tongue 86 into groove 90 of piston 78. Piston 78 and die 74 are secured within channel 92 of die block 94 by retaining plate 95 and screws 97**, as shown, to form the pressing die assembly.

Figure 6:
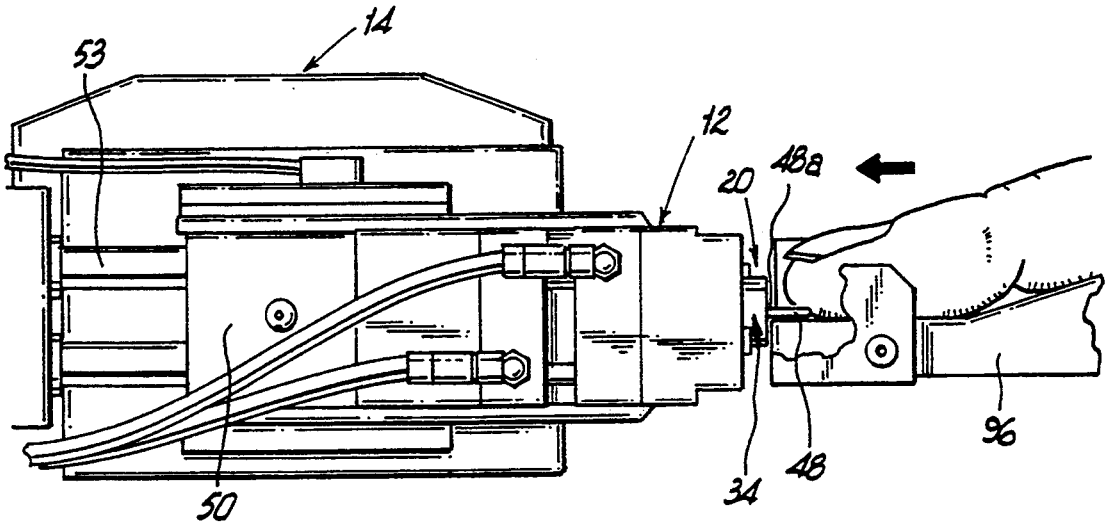

Referring now to FIGS. 1 and 2 in conjunction with FIGS. 6–10, the operation of the positioning and pressing apparatus 10 of the present invention will be described. Initially, the barrel end portion **48*a* of needle blank 48 is inserted between gripping fingers 34 of gripping member 12 from loading tray 96, as shown in FIG. 6. Proximity switch 98, shown in FIG. 1, is positioned on loading tray 96 so that the active portion of the switch is directed toward the loading position 20. Proximity switch 98 is provided to inhibit actuation of needle blank gripping assembly 12 until the operator's fingers are removed from the portion of tray 96** adjacent the loading position.

Figure 7:
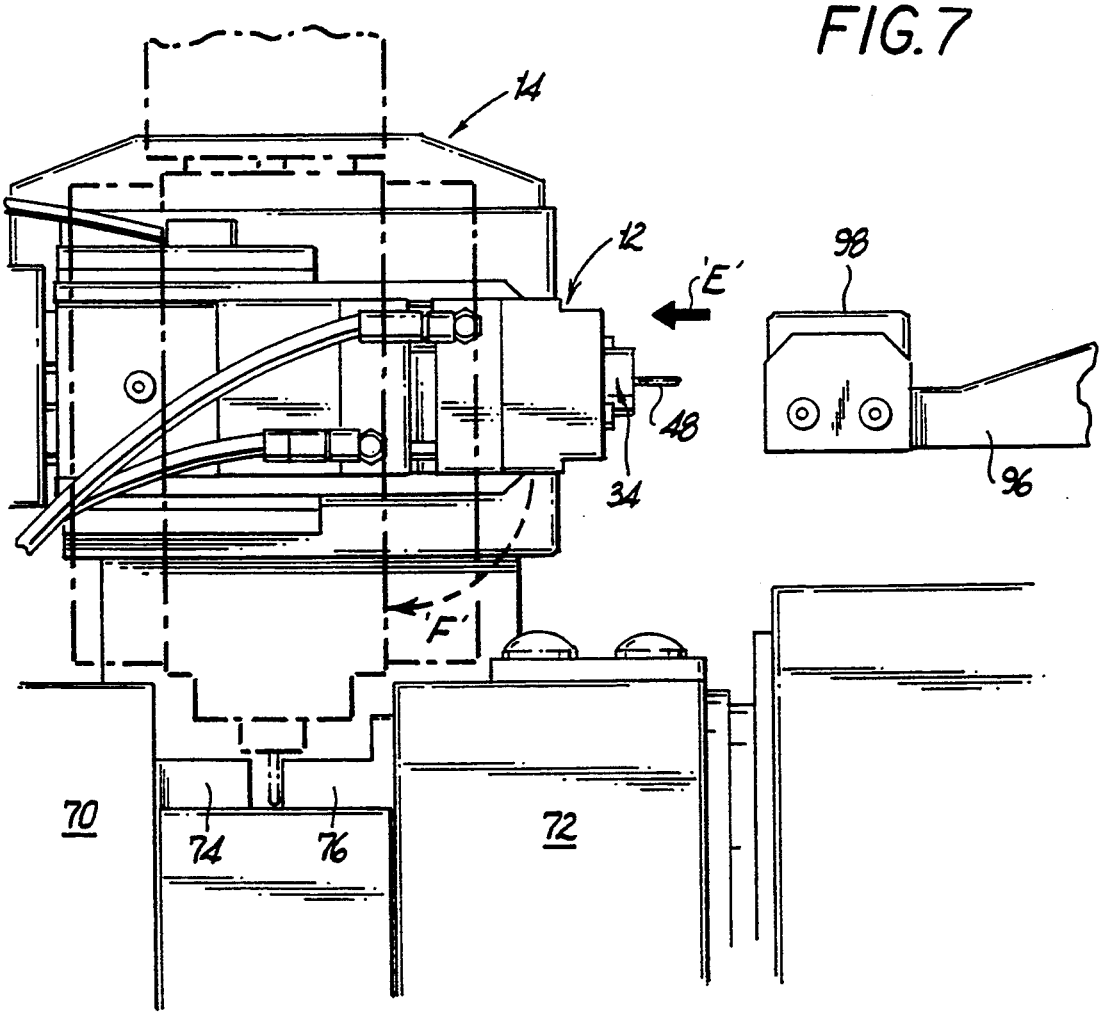

Referring to FIG. 3 in conjunction with FIG. 7, when proximity switch 98 senses the removal of the operator's fingers, collar 30, shown in FIG. 3, of needle blank gripping assembly 12 is moved in direction "A" to the finger closed position, thus maintaining the needle blank between gripping fingers 34. Needle gripping assembly 12 is then moved in the direction of arrow "E" while in the first level to the intermediate position, shown in FIG. 7. Thereafter, needle applying assembly 12 is rotated clockwise toward the 6 O'clock position by rotating arm assembly 54, as seen by arrow "F" in FIG. 7, so that needle blank 48 is transferred to the second level, shown in phantom and aligned for positioning between dies 74 and 76 of the die assemblies.

Figure 8:
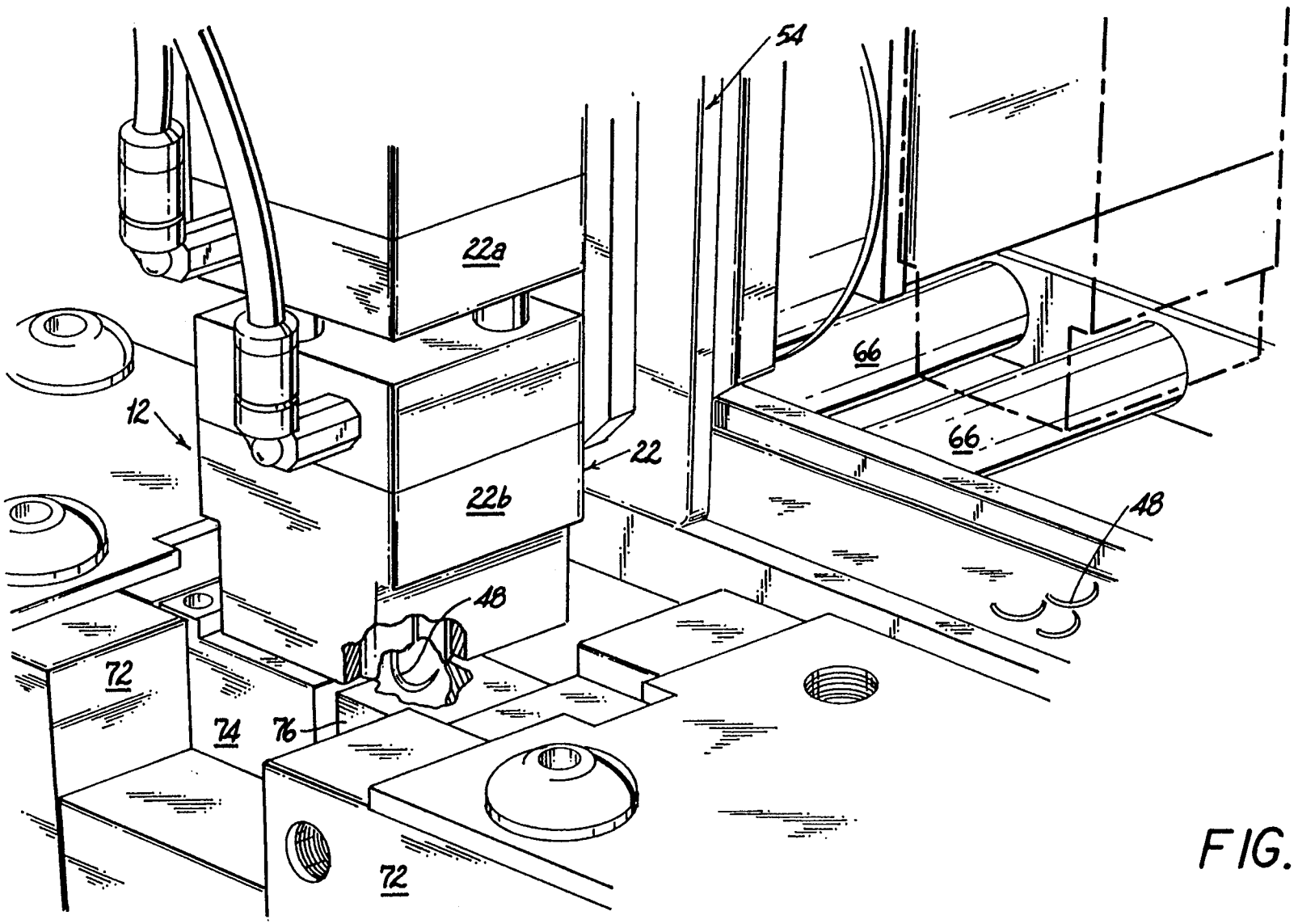

Referring now to FIGS. 8 and 9, once needle blank 48 is at the second level, the needle blank gripping assembly 12 is moved toward die assemblies 70 and 72 until the needle blank is in the pressing position, as shown. After the needle blank is positioned in the pressing position for a predetermined period of time, such as 0.1 to 1000 milliseconds, for example, control unit 18 actuates press drive assembly 68 to cause die 74 to move toward die 76, as seen by arrow "G", so that both dies impact the needle blank and impart a substantial rectangular cross-section thereto.

Referring now to FIG. 10 in conjunction with FIG. 2, after the needle blank is side pressed, die 74 is retracted to release the needle blank and needle blank gripping assembly 12 is retracted to the intermediate position, as seen by arrow "H" in FIG. 10. Collar 30 in gripping assembly 12, shown in FIG. 2, is returned to the open position in a manner described hereinabove, to release the needle blank 48 into storage receptacle 100. Preferably, storage receptacle 100 may include a pad 99 positioned on a base thereof or may be coated with a resilient material so as to provide a surface having a hardness value which is less than the hardness value of the needle blank, to prevent marring of the blank or damage to the point of the blank.

Referring to FIGS. 1 and 10, proximity switch 102 is directed toward gripping fingers 34 of needle blank gripping assembly 12 to ensure that the needle blank has been released from needle blank gripping assembly 12. Proximity switch 102 is connected to control unit 18 and generates a control signal which prohibits further actuation of apparatus 10 until proximity switch 102 detects that the needle blank has been released. When proximity switch 102 detects that the needle blank has been released, needle blank gripping assembly 12 is returned to the loading position 20, shown in FIG. 6.

It will be understood that various modifications can be made to the embodiments of the present invention herein disclosed without departing from the spirit and scope thereof. For example, the needle gripping assembly can be adapted to receive needle blanks of various sizes. Also various modifications may be made in the configuration of the parts, such as the configuration of the pressing dies as well as the force utilized to impact the needle blank. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. Apparatus for positioning and pressing at least one surgical needle blank having a body portion for facilitating inserting into humans or animals, which comprises:

means for transferring the at least one needle blank between a gripping position and a side pressing position;

a gripping assembly attached to said needle blank transferring means and configured for selective automatic actuation to grip and release needle blanks; and means for side pressing the body portion of the needle blank when the needle blank is in the pressing position.

2. The apparatus according to claim 1, wherein said needle blank transferring means is adapted to transfer the needle blank to a release position after the needle blank is side pressed.

3. The apparatus according to claim 1, wherein said needle blank transferring means comprises:

means for moving the needle blank in a first level between said gripping position and an intermediate position;

means for moving the needle blank between said first level and a second level; and means for moving the needle blank in said second level from said intermediate position to said pressing position.

4. The apparatus according to claim 3, wherein said first level is associated with said gripping position and said second level is associated with said pressing position.

5. The apparatus according to claim 3, wherein said means for moving the needle blank between said first level and said second level comprises a rotatable arm having said needle gripping assembly attached thereto at a radial distance from an axis of rotation of said arm.

6. The apparatus according to claim 1, wherein said gripping assembly comprises:

a housing;

at least two gripping fingers at least partially positioned within said housing, each said at least two gripping fingers having a biasing end portion and a gripping end portion which is movable between open and closed positions; and means for engaging said biasing end portion of said at least two gripping fingers to move said gripping end portion between said open and closed positions.

7. The apparatus according to claim 6, wherein said needle gripping member further comprises a needle stop member.

8. The apparatus according to claim 6, wherein said biasing end portion of said at least two gripping fingers is adapted to bias said gripping end portion toward said open position.

9. Apparatus for positioning and pressing surgical needle blanks each having a body portion for facilitating insertion into humans or animals, which comprises:

means for transferring a needle blank between a gripping position and a side pressing position;

a needle gripping assembly attached to said needle transferring means, said needle gripping assembly having at least two needle blank gripping members movable between open and closed positions and means engageable with said blank gripping members for automatically moving said at least two needle blank gripping members between said open position and said closed position; and means for side pressing the body portion of the needle blank when the needle blank is transferred to said pressing position.

10. The apparatus according to claim 9, further comprising a storage receptacle associated with a release position, wherein said needle blank transferring means transfers the pressed needle blanks to said release position to deposit the pressed needle blanks into said storage receptacle.

11. The apparatus according to claim 9, further comprising a loading tray positioned adjacent said gripping position to facilitate insertion of needle blanks between said at least two needle blank gripping members.

12. The apparatus according to claim 9, wherein, said needle transferring means comprises:

a first drive member connected to said needle gripping assembly and configured to move the needle blank between said gripping position and an intermediate position;

a rotatable member connected to said first drive member and adapted to rotate said needle gripping assembly so that the needle blank is aligned for interaction with said side pressing means; and a second drive member connected to said rotatable member and configured to move the needle blank between said intermediate position and said pressing position.

13. The apparatus according to claim 9, wherein said means for moving said at least two needle blank gripping members comprises a collar positioned about at least a portion of said at least two needle blank gripping members and slidable between first and second positions with respect to said at least two needle blank gripping members, said collar being operatively connected to a collar drive member for moving said collar between said first and second positions.

14. The apparatus according to claim 13, wherein said collar first position corresponds to said open position of said at least two needle blank gripping members, and said second position corresponds to said closed position of said at least two needle blank gripping members.

15. The apparatus according to claim 13, wherein said collar drive member comprises a pneumatic piston.

16. The apparatus according to claim 9, wherein said side pressing means comprises a pair of die members configured to impact at least a portion of the needle blank, and hydraulic die drive means to advance at least one of said pair of die members relative to the other to impact the portion of the needle blank.

17. The apparatus according to claim 16, wherein one die member of said pair of die members is stationary and the other die member is connected to said die drive means.

18. A method for pressing surgical needle blanks each having a body portion for facilitating insertion into humans or animals, comprising inserting a needle blank into a needle blank gripping member at a gripping position;

transferring the needle blank in said gripping member between said gripping position and a pressing position; and pressing a side portion of the body portion of the needle blank with pressing dies.

19. The method according to claim 18, further comprising transferring the pressed needle blank to a release position and releasing the needle blank from said needle blank gripping member and wherein said pressing dies are hydraulically driven.

20. Apparatus for side pressing curved surgical needle blanks each having a body port for facilitating insertion into humans or animals, which comprises:

a needle gripper having a housing, a plurality of needle gripping fingers in a fixed longitudinal relationship with said housing and movable between open and closed positions, and a collar longitudinally movable within said housing to cause said needle gripping fingers to move between said open and closed positions;

a needle transferring arm connected to said needle gripper and automatically movable between a gripping position and a pressing position after a needle is gripped by said needle gripper; and a plurality of dies positioned at said pressing position and movable relative to each other such that the body portions of a needle blank are impacted by said dies to side press the needle blank.

* * * * *